US005794400A

United States Patent [19]

Fisher et al.

[11] Patent Number: 5,794,400

[45] Date of Patent: *Aug. 18, 1998

[54] COMPOSITE FRAME MEMBER

[75] Inventors: Larry M. Fisher, 2316 Piedmont Ridge Ct., Marietta, Ga. 30062; Henry W. Gordon, Birmingham, Ala.

[73] Assignee: Larry M. Fisher, Marietta, Ga.

[ * ] Notice: The term of this patent shall not extend beyond the expiration date of Pat. No. 5,577,352.

[21] Appl. No.: 735,015

[22] Filed: Oct. 22, 1996

[51] Int. Cl.[6] ..... E04F 10/00

[52] U.S. Cl. ..... 52/731.2; 52/63; 52/74; 52/466; 52/731.7; 52/732.1; 52/738.1; 156/294; 160/392

[58] Field of Search ..... 52/63, 74, 202, 52/222, 273, 376, 466, 716.1, 717.03, 731.1, 731.2, 731.3, 731.7, 732.1, 732.2, 738.1; 160/46, 56, 57, 83.1, 76, 391, 392, 393, 395, 397, 398, 399, 402, 404; 156/293, 294

[56] References Cited

U.S. PATENT DOCUMENTS

| | | | |
|---|---|---|---|
| D. 309,351 | 7/1990 | Pasty, Jr. . | |
| 2,287,667 | 6/1942 | Brown . | |
| 2,834,412 | 5/1958 | Velke | 160/395 |
| 3,559,357 | 2/1971 | Lowe . | |
| 3,834,104 | 9/1974 | Dunn et al. . | |
| 4,193,235 | 3/1980 | Cucchiara . | |
| 4,272,073 | 6/1981 | Grosser et al. . | |
| 4,690,192 | 9/1987 | Stilling | 160/57 |
| 4,726,869 | 2/1988 | Matsui et al. | 156/294 X |
| 4,817,655 | 4/1989 | Brooks . | |
| 4,926,605 | 5/1990 | Milliken et al. . | |
| 5,044,131 | 9/1991 | Fisher . | |
| 5,172,743 | 12/1992 | Wallace et al. | 160/67 |
| 5,209,029 | 5/1993 | Foerest . | |
| 5,224,306 | 7/1993 | Cramer . | |
| 5,237,785 | 8/1993 | Lukes . | |
| 5,242,004 | 9/1993 | Stilling . | |
| 5,259,323 | 11/1993 | Koch et al. | 160/395 X |
| 5,291,705 | 3/1994 | Dickerson . | |
| 5,469,672 | 11/1995 | Fisher . | |
| 5,577,352 | 11/1996 | Fisher | 52/74 |

*Primary Examiner*—Carl D. Friedman
*Assistant Examiner*—Kevin D. Wilkens
*Attorney, Agent, or Firm*—Isaf, Vaughan & Kerr

[57] ABSTRACT

A composite frame member that includes a longitudinally extending external member that defines a longitudinally extending internal cavity within which a longitudinally extending internal member is disposed. The internal member and external member, while being distinct components, are constructed and arranged to cooperate in a substantially synergistic fashion that seeks to provide a frame member having superior strength characteristics. Further, the internal member and the external member cooperate to define an accessible stapling channel that is capable of being readily stapled into. The external member includes walls that at least partially bound the internal cavity. The internal member is disposed within the internal cavity and defines the stapling channel, wherein the stapling channel receives a cover sheet and staples through an opening defined by the external member. The internal member spans between and abuts certain walls of the external member to uniquely structurally reinforce the external member and thereby provide a composite frame member of considerable strength. In at least one embodiment, the invention includes a method of integrating the formation processes of the internal member and the external member.

18 Claims, 12 Drawing Sheets

COMPOSITE FRAME MEMBER

BACKGROUND OF THE INVENTION

The present invention relates generally to the field of frame members, and more particularly to the field of frame assemblies that are covered with a cover sheet.

Construction assemblies of the type that include frame assemblies that are covered with a cover sheet are well known and function, for example, as awnings, signs, partitions, and various enclosures. The frame assemblies are constructed of a plurality of frame members. One such type of frame members is elongated and defines elongated stapling channels. The cover sheet is often constructed from pieces of fabric composed of woven acrylic or vinyl laminated on a polyester scrim. The cover sheet spans between and is stapled or clipped into the stapling channels of the frame members. Once the cover sheet is stapled into a stapling channel, it is common for an elongated bead or strip to be driven partially into the stapling channel. Representative construction assemblies and frame members are disclosed in U.S. Pat. No. 4,926,605 issued to Milliken et al., as well as numerous other patents.

Frame members are often unitary extrusions of aluminum. Aluminum is a relatively soft metal such that steel staples are capable of being readily stapled into the stapling channels of aluminum frame members. Frame members are also often constructed of steel. However, there are some drawbacks to utilizing steel frame members of the type having conventional stapling channels. For example, steel is a relatively hard metal such that it can be impossible to staple steel stapes into the stapling channels of steel frame members. Any such difficulty in stapling will detrimentally increase the costs associated with the use of steel frame members.

The difficulty of stapling into the stapling channel of steel frame members has, to a limited degree, been addressed. As disclosed in U.S. Pat. No. 4,926,605, it is known to place a strip of nylon or similar material at the bottom of a steel stapling channel such that the strip of nylon is capable of readily receiving staples. While the employment of such a strip of nylon does seek to simplify the process of stapling into the stapling channel of steel frame members, it is otherwise of limited value. For example, such a strip of nylon might tend to become dislodged and does not add any substantial strength to the frame member associated therewith. Further, strips of nylon typically have a characteristic of being somewhat "slick" (e.g., they are not abrasive) such that they are ineffective at retaining staples when the cover sheet is subjected to maximum wind and snow loads. Under such conditions the staples have a tendency to pull out of the nylon strip. The inability of the nylon strips to retain staples is enhanced by the fact that the bottom of the stapling channel of a steel frame member is defined by a steel part upon which a nylon strip rests, whereby staples are precluded from substantially passing through the nylon strip. Further, when steel frame members which include nylon strips are welded, the nylon strips tend to burn or melt such that noxious fumes are emitted. Thus, such steel frame members are often joined with mechanical fittings such as tees or elbows, which are cost prohibitive when compared to welded joints. Additionally, mechanical fittings are less versatile in terms of the configurations in which they can be utilized in connecting frame members. That is, a different style of fitting is needed for different joint scenarios. Also, mechanical fittings typically do not provide joints that are as strong as welded joints.

While aluminum frame members that have stapling channels offer benefits greater than steel frame members having stapling channels (with or without nylon stapling strips), there are numerous short comings to such aluminum frame members. In order for staples to be driven into aluminum stapling channels, aluminum must be of a relatively soft temper; typically a T-5. This material has roughly half the strength characteristics of cold formed steel. Also, aluminum is a relatively expensive metal when compared to steel, having a cost approximately twice that of cold formed steel. Due to the combination of the relative weakness and higher unit cost of aluminum, aluminum frame members with aluminum stapling channels are considerably more expensive to produce than their steel counterparts. Further, methods used in welding aluminum are more time consuming and technical in nature than those for welding steel, adding additional expense to construction assemblies that include aluminum frame members. The number of recovering is potentially limited because there is a limit to the number of times staples can be driven into and removed from the stapling channel of an aluminum frame member. If staples are repeatedly applied to and removed from the stapling channel, the part that defines the bottom of the stapling channel will eventually become so perforated that it will not effectively retain staples. This limits the number of times that a given frame assembly is capable of being readily recovered.

There is, therefore, a need in the industry for a method and an apparatus which solve these and other related, and unrelated, problems.

SUMMARY OF THE INVENTION

Briefly described, the preferred embodiment of the present invention comprises a longitudinally extending, composite frame member that defines a longitudinally extending stapling channel. The composite frame member includes a relatively hard, longitudinally extending external member that defines a longitudinally extending internal cavity. A relatively soft, longitudinally extending internal member is disposed within the internal cavity. The internal member and external member, while being distinct components, are constructed and arranged to cooperate in a substantially synergistic fashion such that the frame member has superior strength characteristics. The internal member and the external member further cooperate such that the internal member defines a stapling channel that is capable of being readily stapled into.

In accordance with the most preferred embodiment of the present invention, the external member is constructed of a hard and strong material such as, but not limited to steel. The strength of the steel allows for the construction of very strong frame assemblies which include a minimal number of frame members. The steel is preferably formed such that the external member includes a pair of juxtaposed, longitudinally extending, vertical side walls. The side walls are connected by a longitudinally extending, horizontal bottom wall. The longitudinally extending internal cavity is defined between the side walls and is further bounded by the bottom wall. A pair of longitudinally extending, horizontal upper walls are disposed above the bottom wall and also at least partially bound the internal cavity. Each upper wall extends generally from a respective side wall toward the opposite side wall, and a longitudinally extending opening is defined between the upper walls that provides access to the internal cavity.

The internal member is disposed within the internal cavity and receives the cover sheet and staples through the opening.

In accordance with the most preferred embodiment of the present invention, the internal member is constructed of a material that, while strong, is not as hard or strong as the material of the external member. The internal member spans between and abuts certain walls of the external member to uniquely structurally reinforce the external member and thereby provide a composite frame member of considerable strength.

Most preferably, the internal member includes a longitudinally extending, lateral member disposed within the internal cavity. The internal member further includes a pair ofjuxtaposed, longitudinally extending, vertical upright members that extend upward from the lateral member. The pair of upright members and the lateral member define boundaries of a longitudinally extending stapling channel.

In accordance with a first preferred embodiment, the internal member includes an elongated lateral member sized to extend across the internal cavity of the external member from one side wall to the other side wall of the external member; and the internal member further includes a pair of juxtaposed, longitudinally extending, vertical upright members that extend upward from the lateral member from locations intermediate the outer edges of the lateral member that is, the upright members of this alternate embodiment do not abut the side walls of the external member.

In a second preferred embodiment, the internal member includes an elongated lateral member sized to extend across the internal cavity of the external member from one side wall to the other side wall of the external member; and the internal member further includes upstanding side walls and upper wall protrusions, which side walls and upper wall protrusions abut and track the inner surface of the external member.

In each of the mentioned embodiments, the internal member seeks to preclude the collapsing of the internal cavity of the external member, and seeks to maintain the configuration of the internal cavity, the stapling channel and the opening to the stapling channel.

The present invention further includes a method associated with the simultaneous formation of the external member and the internal member such that the composite frame member results from this simultaneous, integrated formation process. Whereas it is within the scope of the invention to separately form the internal member and the external member, and then combine the two, for example, by insertion of the internal member into the external member after fabrication of the separate members has been completed, the present invention includes, as one embodiment, a method of integrating the formation processes of the internal member and the external member.

It is therefore an object of the present invention to provide a composite frame member.

Another object of the present invention is to provide a method of fabricating a composite frame member.

Yet another object of the present invention is to provide a frame member that incorporates the advantages of two distinctly different materials.

Still another object of the present invention is to provide a stronger frame member.

Still another object of the present invention is to provide a reinforced frame member Still another object of the present invention is to provide a multipurpose internal member that inserts into an external member to both reinforce the external member and facilitate the attachment of a cover sheet to the external member.

Still another object of the present invention is to provide an improved frame member so that construction assemblies can include less frame members.

Still another object of the present invention is to decrease the cost of frame members and thereby decrease the cost of construction assemblies.

Still another object of the present invention is to decrease the amount of time required for the building of frame assemblies.

Other objects, features and advantages of the present invention will become apparent upon reading and understanding this specification, taken in conjunction with the accompanying drawings.

BRIEF DESCRIPTION OF THE DRAWINGS

FIGS. 19-1–19-4 are isolated end views of selected bending stations along the cold rolling system assembly in accordance with one preferred embodiment for forming of a composite frame member in accordance with the present invention, with the product components of the composite frame member depicted in cross-section.

DETAILED DESCRIPTION OF THE PREFERRED EMBODIMENT

Figure 1:
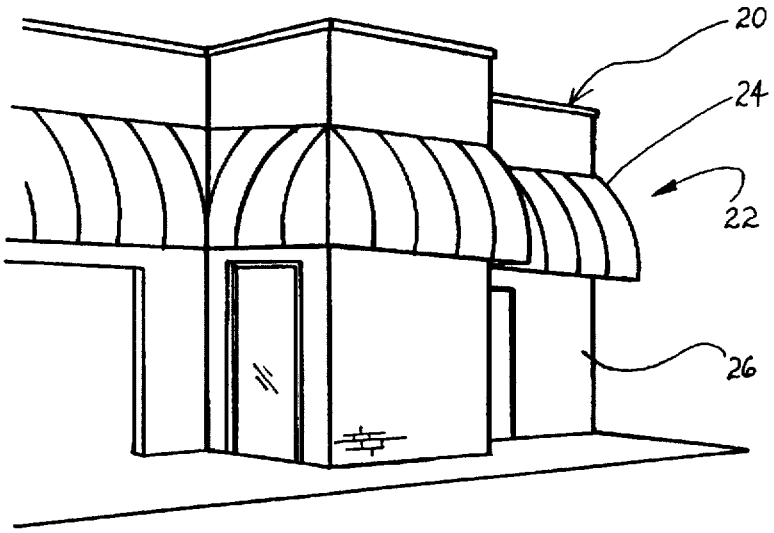
FIG. 1 is a perspective view of a building with an exemplary construction assembly, in the form of an awning, attached thereto, in accordance with the preferred embodiment of the present invention.
Figure 2:
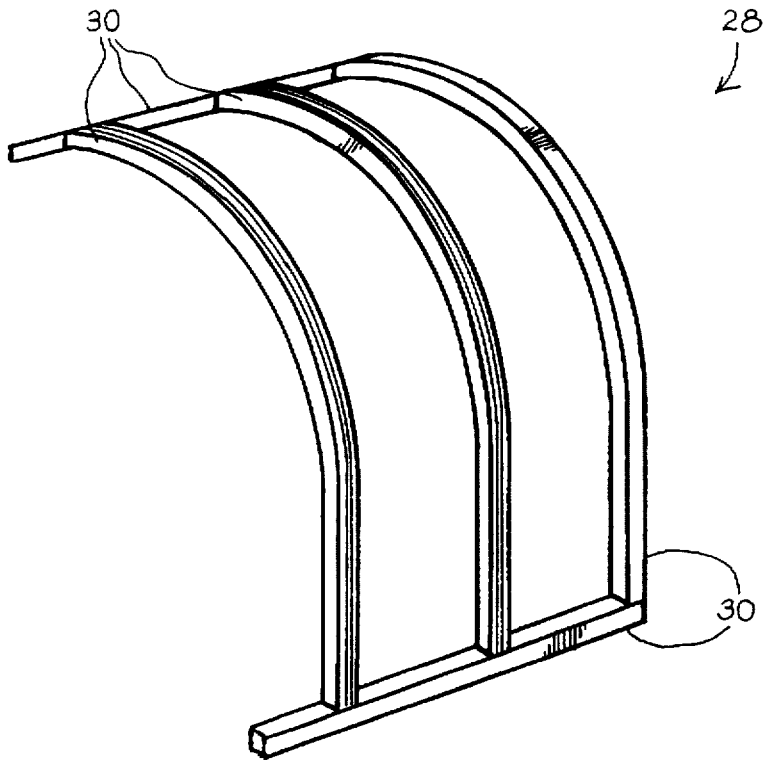
Fig. 2 is an isolated, cut-away, perspective view of a frame assembly of the construction assembly of FIG. 1, in accordance with the preferred embodiment of the present invention.

Referring now in greater detail to the drawings, in which like numerals represent like components throughout the several views, FIG. 1 is a perspective view of a building 20 with a construction assembly 22 attached thereto. The construction assembly 22 depicted in FIG. 1 is in the form of an awning; however, a wide variety of construction assemblies such as, but not limited to, signs, partitions, and various enclosures, are also within the scope of the present invention. In accordance with the preferred embodiment of the present invention, the construction assembly 22 includes a cover sheet 24 and is connected to a wall 26 of the building 20. The cover sheet 24 is preferably a flexible covering material constructed, for example and not limitation, from pieces of fabric, such as polyester or acrylic. FIG. 2 is an isolated, cut-away, perspective view of a frame assembly 28 portion of the construction assembly 22 of FIG. 1, in accordance with the preferred embodiment of the present invention. The frame assembly 28 is preferably constructed from a plurality of elongated frame members 30 that are connected. The cover sheet 24 spans between and attaches to the frame members 30.

Figure 3:
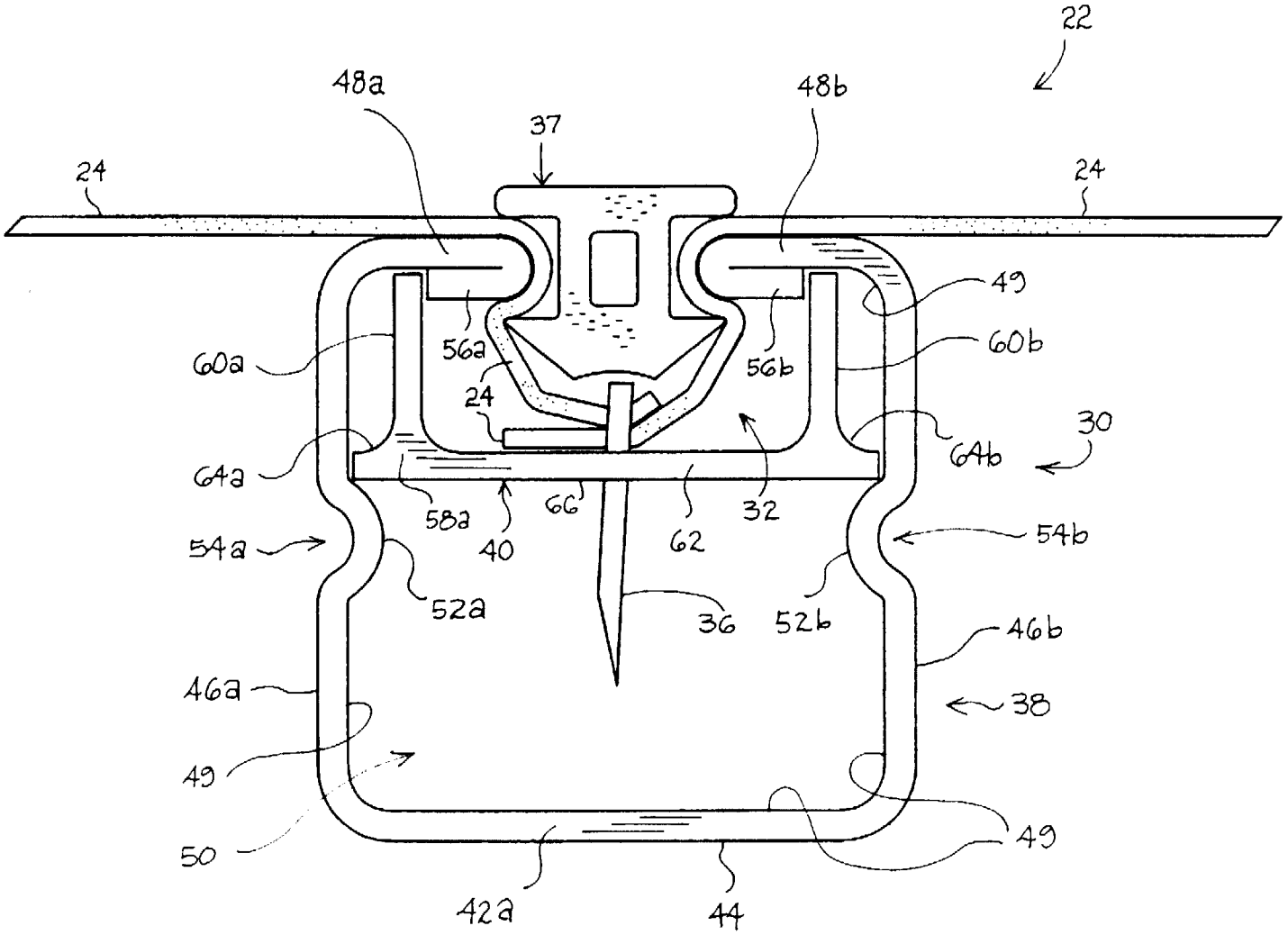
FIG. 3 is an end elevational view of an isolated portion of the construction assembly of FIG. 1, wherein an end elevational view of a segment of a frame member is depicted with portions of other construction assembly components attached thereto in accordance with a first preferred embodiment of the present invention.

FIG. 3 is an end elevational view of an isolated portion of the construction assembly 22, wherein an end elevational view of a representative segment of a representative frame member 30 is depicted. The frame member 30 is central to the inventive aspects of the present invention. In accordance with the preferred embodiment of the present invention, the frame member 30 defines an elongated stapling channel 32 into which portions of the cover sheet 24 are attached by piercing members such as, but not limited to, staples 36. Once the cover sheet 24 and staples 36 are applied to the stapling channel 32, the stapling channel 32 is preferably occluded by an elongated bead or strip member 37 that is driven partially into the stapling channel 32. The strip member 37 functions, for example, to keep moisture out of the stapling channel 32, make the cover sheet 24 taught, and enhance the appearance of the construction assembly 22.

As mentioned above, the frame member 30 is central to the inventive aspects of the present invention. In accordance with the preferred embodiment of the present invention, the frame member 30 includes a longitudinally extending external member 38 that houses a longitudinally extending internal member 40. In accordance with the preferred embodiment of the present invention, and as will be discussed in greater detail below, the external member 38 is preferably constructed of material that is too hard to readily receive steel staples 36, while the internal member 40 is preferably constructed of a softer material that is capable of readily receiving steel staples 36. The external member 38 preferably functions as a structural member having a high yield strength, while the internal member 40 functions as a structural member that reinforces the external member 38 and is capable of readily receiving staples 36, or the like. More specifically, and as will be discussed in greater detail below, the members 38,40 are constructed and arranged such that they cooperate in a synergistic fashion that seeks to maintain the overall shape of the frame member 30.

Refer also to FIGS. 4–7 which are various isolated end, top, side, and bottom views, respectively, of the external member 38 of FIG. 3. The external member 38 includes opposite ends 42*a,b*, between which the length of the external member 38 is defined. The external member 38 is preferably uniform along its length. A pair of side walls 46*a,b* extend upward from a bottom wall 44, and a pair of upper walls 48*a,b* extend toward one another from the upper end of the side walls 46*a,b*, respectively. Each of the walls 44, 46*a,b*, 48*a,b* extend longitudinally between the opposite ends 42*a,b*. Additionally, the walls 44, 46*a,b*, 48*a,b* cooperate to partially bound and define an internal cavity 50 that extends longitudinally between and is open at the opposite ends 42*a,b*. Stated differently, the external member 38 includes an internal surface 49 that partially bounds and defines the internal cavity 50. Additionally, an opening 51 is defined between the upper walls 48*a,b* and extends between the opposite ends 42*a,b*. The opening 51 provides access to the internal cavity 50 and the cover sheet 24 and the staples 36 are preferably passed through the opening 51 to achieve their ultimate position within the internal cavity 50. The side walls 46*a,b* define longitudinally extending side protrusions 52*a,b*, respectively, that protrude into the internal cavity 50 and form longitudinally extending recesses 54*a,b*, respectively. The recesses 54a,b function, for example, to receive additional welding material in a manner that facilitates the attachment of frame members 30 to one another as well as to other structures. The upper walls 48*a,b* define upper protrusions 56*a,b*, respectively, that protrude into the internal cavity 50 and define edges 57*a,b* (FIG. 4), respectively, that face away from the opening 51. Each of the protrusions 52*a,b*, 56*a,b* extend longitudinally between the opposite ends 42*a,b*.

Refer now to FIG. 3 and additionally to FIGS. 8–11 which are isolated end, top, side, and bottom views, respectively, of the internal member 40 of one preferred embodiment of the present invention. The internal member 40 includes opposite ends 58*a,b*, between which the length of the internal member 40 is defined. The internal member 40 is preferably uniform along its length. A pair of longitudinally extending upright members 60*a,b* extend upward from a longitudinally extending lateral member 62 and terminate at a position proximate to (i.e., contacting or close to) the upper protrusions 56*a,b*, respectively. Referring momentarily to both FIG. 3 and FIG. 4, the upper terminus of the upright member 60*a* is preferably proximate to (i.e., contacting or close to) the underside of the upper wall 48*a* and the edge 57*a* of the upper protrusions 56*a*; and the upper terminus of the upright member 60*b* preferably abuts (or nearly abuts) the underside of the upper wall 48*b* and the edge 57*b* of the upper protrusions 56*b*. The stapling channel 32 is at least partially bound and defined by the lateral member 62 and upright members 60*a,b*.

In the embodiment of FIGS. 3, 8–11, the upright members 60*a,b* of the internal member 40 protrude from the lateral member 62 at locations intermediate of the opposite side edges 64*a*, 64*b* of the lateral member. In this embodiment, the side edges 64*a*, 64*b* of the lateral member 62 are positioned, in the composite member 30, proximate to (i.e., contacting) or close to the side protrusions 52*a,b*, respectively. Most preferably, the bottom edges of the opposite sides 64*a,b* rest upon upper shoulders of the side protrusions 52*a,b*, respectively, along the entire length of the frame member 30 such that the internal member 40 is suspended within the internal cavity 50. The lateral member 62 further includes a mid-span 66 between the upright members 60*a,b* that preferably receives the staples 36.

Figure 12:
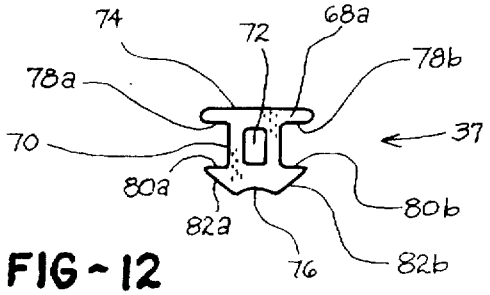
FIG. 12 is an isolated, end elevational view of a segment of a strip member depicted in FIG. 3, send opposite being a mirror image, in accordance with the preferred embodiment of the present invention.
Figure 13:
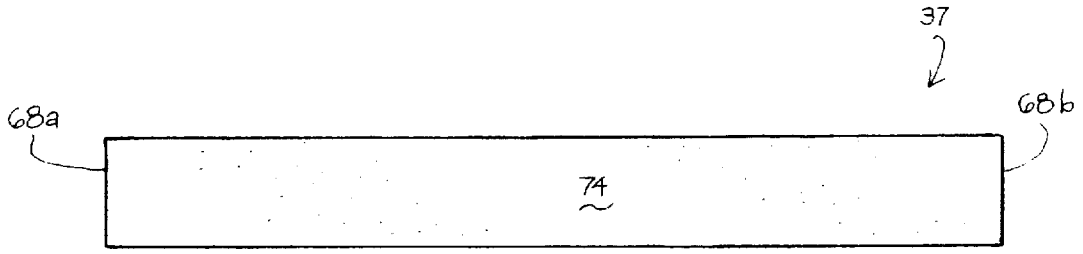
FIG. 13 is an isolated, top plan view of the strip member of FIG. 12.
Figure 14:
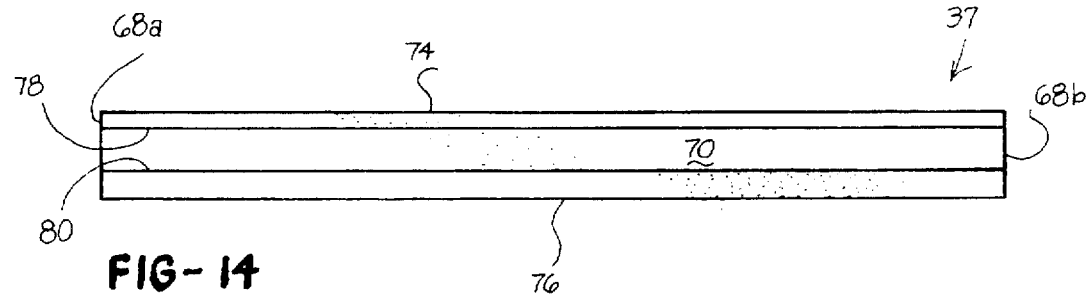
FIG. 14 is an isolated, side elevational view of the strip member of FIG. 12, the side opposite being, mirror image.
Figure 15:
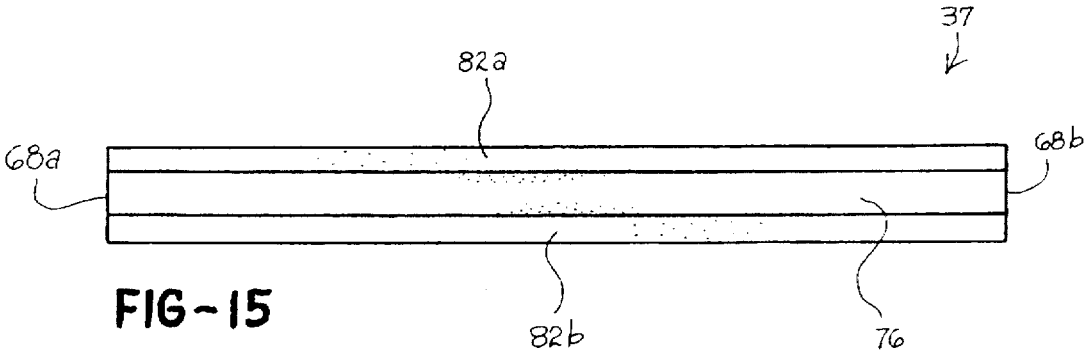
FIG. 15 is an isolated, bottom plan view of the strip member of FIG. 12.

Refer now primarily to FIG. 12 and additionally to FIGS. 3 and 13–15. FIGS. 12–15 are isolated end, top, side and bottom views, respectively, of a representative segment of the strip member 37 of FIG. 3. The strip member 37 includes opposite ends 68*a,b* (FIGS. 13–15) between which the length of the strip member 37 is defined. The strip member 37 is preferably uniform along its length. The strip member includes a central shank 70 that defines a longitudinally extending passage 72 that is open at the ends 68*a,b*. An upper flange member 74 extends from the top of the shank 70 and a lower flange member 76 extends from the bottom of the shank 70. The upper flange member 74 defines upper shoulders 78*a,b*, and the lower flange member 76 defines lower shoulders 80*a,b* that face the upper shoulders 78*a,b*, respectively. The strip member 37 is preferably flexible and resilient such that the upper shoulder 78*a* and lower shoulder 80*a* cooperate to define a void therebetween that releasably receives the upper wall 48*a* (FIG. 3) and the upper protrusion 56*a* (FIG. 3); and the upper shoulder 78*b* and lower shoulder 80*b* cooperate to define a void therebetween that releasably receives the upper wall 48*b* (FIG. 3) and the upper protrusion 56*b* (FIG. 3). The lower flange member 76 further includes angled faces 82*a,b* that function to promote the insertion of the strip member 37 partially into the stapling channel 32.

Figure 16:
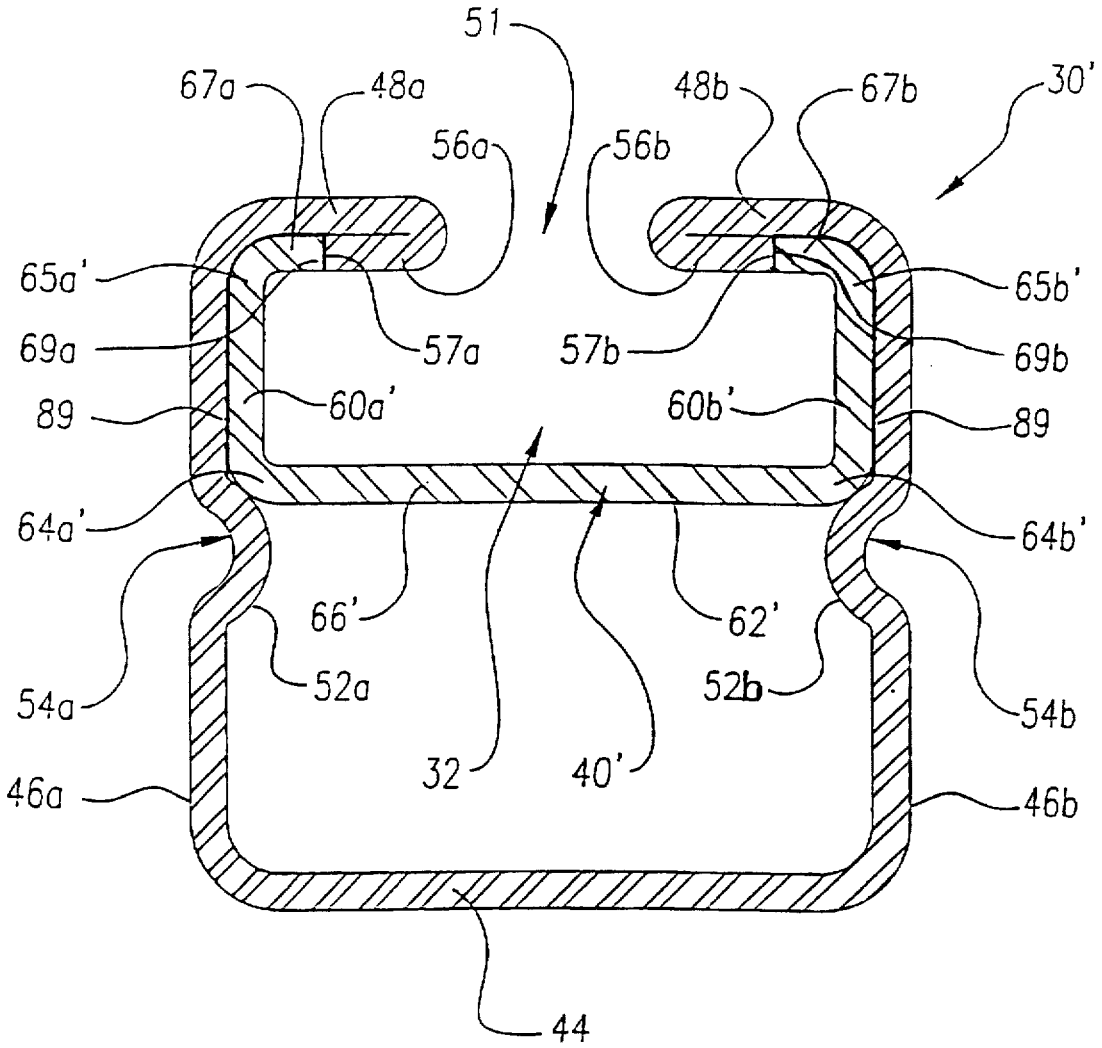
FIG. 16 is an end elevational view of a structural frame member, in accordance with a second preferred embodiment of the present invention.

With reference now to FIG. 16, a second, preferred embodiment of the structural members 30' is seen. In this second preferred embodiment, it is seen that the external member 38 is identical in its construction to that shown in FIGS. 3–7; and, thus, reference can be made to the descriptions of FIGS. 3–7 when referring to the external member; and the relevant component parts are indicated by like numerals in this FIG. 16. The internal member 40' of the embodiment of FIG. 16 is seen as being of different shape than the internal member 40 of the embodiment shown in FIGS. 3–7. The internal member 40' defines a more "C-shape" design in which the upright members 60*a'*, 60*b'* transition from and extend from the outermost "edges" 64*a'*, 64*b'* of the lateral member 62', rather than extending from locations intermediate the side edges of the internal member. The upright members 60*a'*, 60*b'* extend perpendicularly away from the lateral member 62' and transition at their distal ends 65*a'*, 65*b'* to form upper walls 67*a*, 67*b*, which upper walls protrude, as shown, generally parallel to the lateral member 62'. When the internal member 40' of the embodiment of FIG. 16 is combined with the external member 38, it interfaces with the external member as seen in FIG. 16 where, most preferably: the bottom of the lateral member side edges 64*a'*, 64*b'* rest upon shoulders of the side protrusions 52*a*, 52*b*, respectively, of the external member 38; the upright members 60*a'*, 60*b'* abut and closely track the inner surfaces of the external member as seen in FIG. 16; and the upper walls 67*a*, 67*b* of the internal member abut at their terminal ends 69*a*, 69*b* against the edges 57*a*, 57*b* of the external member. The composite, structural frame member 30' of this second, preferred embodiment of FIG. 16 functions within the construction assembly 22 in a manner similar to that of the structural frame member 30 as shown in the embodiment of FIG. 3. That is, the interaction of the cover 24, strip member 37 and staples 36 with the structural frame member 30' of FIG. 16 is similar to the interaction depicted and described with respect to FIG. 3.

Referring back to FIG. 3, as mentioned above, in accordance with the preferred embodiments of the present invention, the external member 38 is preferably constructed of material that is generally too hard to readily receive steel staples 36, while the internal member is preferably constructed of a material that is sufficiently soft to readily receive steel staples 36. For example, the external member 38 is preferably constructed of a hard and strong material such as, but not limited to, steel. In accordance with the preferred embodiments of the present invention, the internal member 40 is constructed of a material that is rigid enough to structurally reinforce the external member 38, is soft enough to readily receive the staples 36, and is abrasive enough to engage (i.e., hold on to) the staples 36. In accordance with the preferred embodiments of the present invention, the internal member 40 is constructed of a material such as, but not limited to, aluminum. In accordance with that example, the external member 38 preferably has a higher yield strength than the internal member 40. Most particularly, the steel of the external member 38 is preferably galvanized; and alternately the steel is covered with a plastic coating or painted. In accordance with alternate embodiments of the present invention, the internal member 40 is constructed of materials such as, but not limited to, a material sold under the trademark DELRIN, carbon composite materials, or fiberglass.

Figure 17:
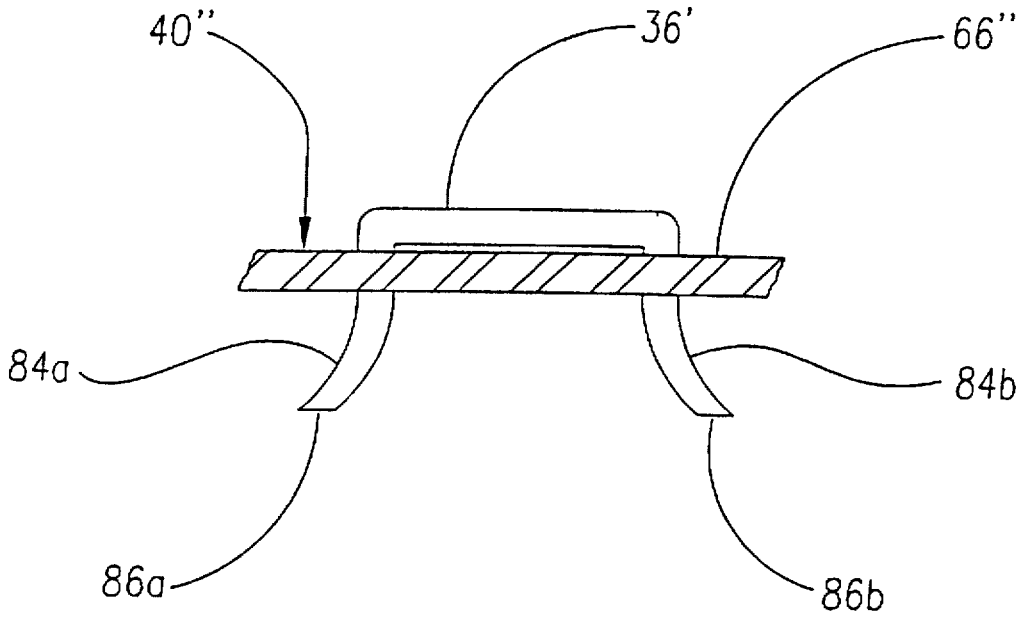
FIG. 17 is a side, partial cross-sectional, cut-away view of a portion of an internal member engaging a staple, in accordance with an alternate embodiment of the present invention.

In accordance with other alternate embodiments of the present invention, the internal member 40 is constructed of plastics such as, but not limited to, nylon. FIG. 17 is a side cross-sectional, cut-away view of a portion of a plastic internal member 40", in accordance with an alternate embodiment of the present invention. The staple 36' depicted in FIG. 17 includes prongs 84*a,b* which tend to diverge upon passing through a member such as, but not limited to, the mid-span 66" of the internal member 40". Referring momentarily back to FIGS. 3 and 16, an important feature of the preferred and certain alternate embodiments of the present invention is that the bottom side of the mid-span 66 portion of the internal member 40 is displaced from the external member 38. This enhances the effectiveness of the staples 36,36'. More particularly, this enhances the effectiveness of the staple 36' by virtue of the fact that the tips of the prongs 84*a,b* are capable of passing completely through and extending divergently from the mid-span 66' of the internal member 40", as depicted in FIG. 17. The divergent nature of the prongs 84*a,b* is acceptably facilitated, for example and not limitation, by oppositely angled faces 86*a,b* defined proximate to the tips of the prongs 84*a,b* respectively. As the angled faces 86*a,b* are forced through the mid-span 66", the angled faces 86a,b contact the material of the mid-span 66" such that the tips of the prongs 84*a,b* are forced away from each other, whereby the staple 36' "locks" to the internal member 40".

In accordance with the preferred embodiments of the present invention, the external member 38 is preferably formed from a longitudinally extending, generally planar sheet of steel. The sheet of steel is bent into the shape of the external member 38. For example, the opposite edges of the sheet of steel are preferably "doubled over" to form the upper protrusions 56*a,b*. In accordance with one acceptable example, the external member 38 is formed by continuously feeding a longitudinally extending sheet of steel into one end of a "staged" roll former such that an external member 38 continuously flows out of the opposite end of the roll former. As the sheet passes through the roll former it is successively acted on by a plurality of hardened rolling dies. In other words, the roll former includes a series of dies, and a given segment of the sheet encounters one set of dies after another until it finally exits the roll former in the form of the external member 38. As the external member 38 exits the roll former it is preferably automatically cut into appropriate lengths.

In accordance with the first preferred embodiment of the present invention, the internal member 40 (of FIGS. 4–11) is preferably extruded in the shape depicted. After both the external member 38 and the internal member 40 are formed, it is preferable to insert the internal member 40 into the internal cavity 50 of the external member 38 from an end 42 of the external member 38, whereby the frame member 30 is created. So constructed, frame members 30 are capable of being various lengths, however it might be preferable to initially fabricate the frame members 30 in thirty foot lengths.

As mentioned previously, there is, at least theoretically, some limit to the number of times that staples 36 can be driven into the stapling channel of an aluminum frame member (not shown). If staples 36 are repeatedly applied to and remove from the stapling channel, the member that defines the bottom of the stapling channel will eventually become so perforated that it will not effectively retain staples 36. The first preferred embodiment of the present invention overcomes such a problem by virtue of the fact that, if desirable, under certain conditions an "overly perforated" internal member 40 can be withdrawn from the internal cavity 50 of an external member 38 and replaced with a new internal member 40.

Figure 18:
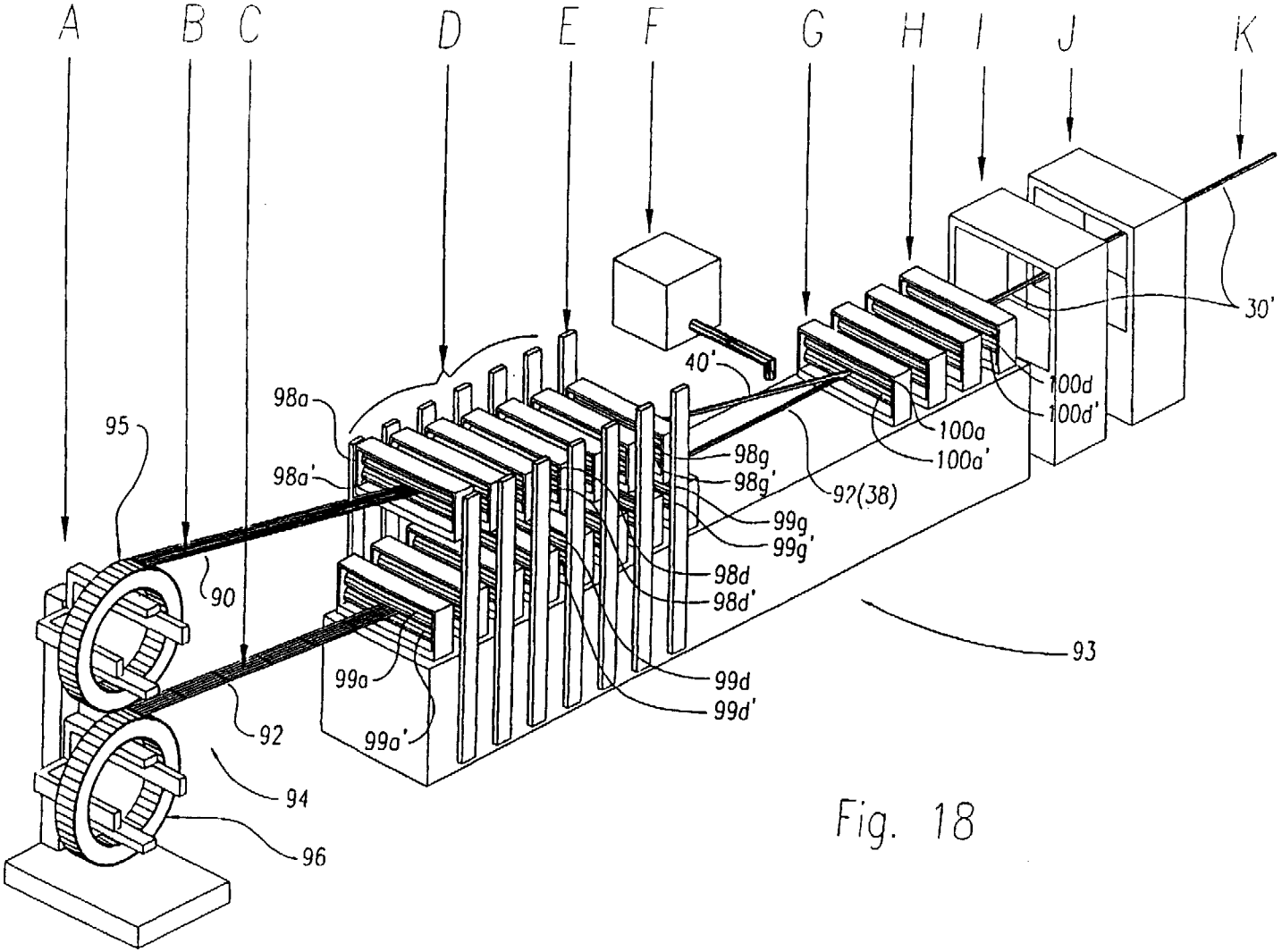
FIG. 18 is a schematic representation of an integrated process associated with the formation of the structural member of FIG. 16.

In accordance with the second preferred embodiment of the present invention, the internal member 40' is formed from a longitudinally extending, generally planar sheet of material (such as, for example, aluminum). The internal member 40' is fabricated (e.g. by staged bending) simultaneously with the fabrication of the external member 38, such that the internal member and external member are bent and formed simultaneously to form the integrated, composite frame member 30'. In accordance with a preferred embodiment of the present invention the preferred process for forming the composite member 30' of this second embodiment is a cold rolling process performed on a roll forming assembly schematically represented as the system assembly 93 in FIG. 18. The (for example) aluminum sheet 90 is taken from the upper row in the schematic and the steel sheet 92 is taken from the lower roll in the schematic. Each sheet 90, 92 is fed through a plurality of preliminary-stage roller identified generally by the letters "D" and "E". The rollers of the upper and lower forming lines in this preliminary-stage are, preferably, nestled alternately to reduce the entry angle between the two strip components into the final forming stage identified as beginning at "G". One example of an acceptable arrangement includes the upper rollers having a pitch diameter of three inches and the lower rollers having a pitch diameter of four inches, with the upper rollers being spaced approximately ten inches apart and the upper rollers being nested between the lower rollers. The two sheets 90, 92 enter Station "G" at relative entry angles which result, preferably, in an angle between the two sheets in the range of 10 to 25 degrees, with the steel sheet 92, preferably, entering along a horizontal plane.

Referring now to FIGS. 18 and 19-1 through 19-4, the basic steps associated with a preferred embodiment of fabrication process are outlined below;

A. At point "A", a double uncoiler 94 is shown supporting rolled aluminum sheet stock 90 on upper uncoiler reel 95 and rolled galvanized steel 92 on a lower uncoiler reel 96.

B. At point "B", the aluminum sheet 90 (also referred to as the "insert", since it will be inserted into the external member 38) is flat between the uncoiler 94 and the preliminary stage rollers at station "D".

C. At point "C", the steel sheet 92 (also referred to herein as the "shell") is also flat between the uncoiler 94 and station "D".

Figures 1, 19:
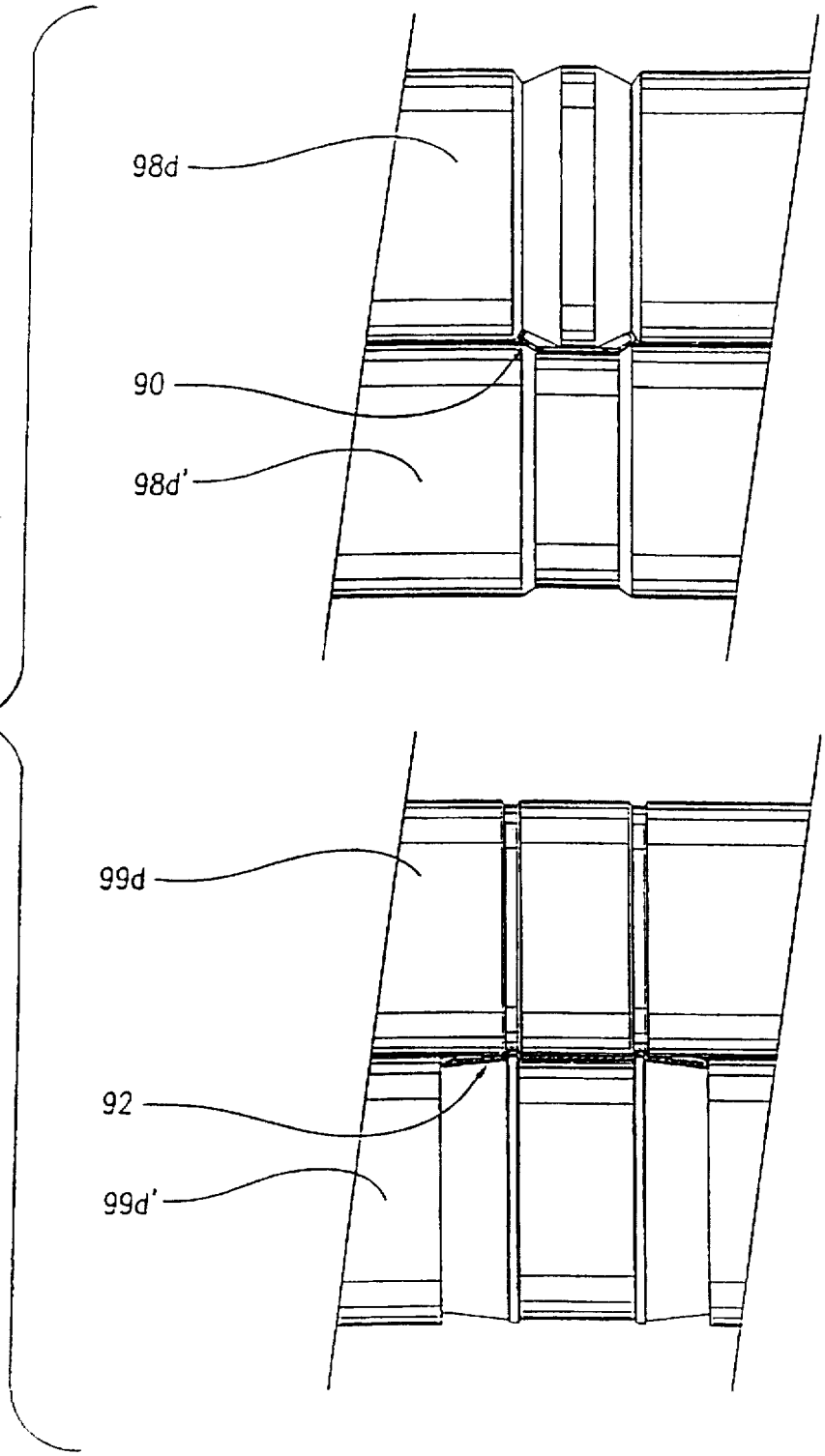
Figures 2, 19:
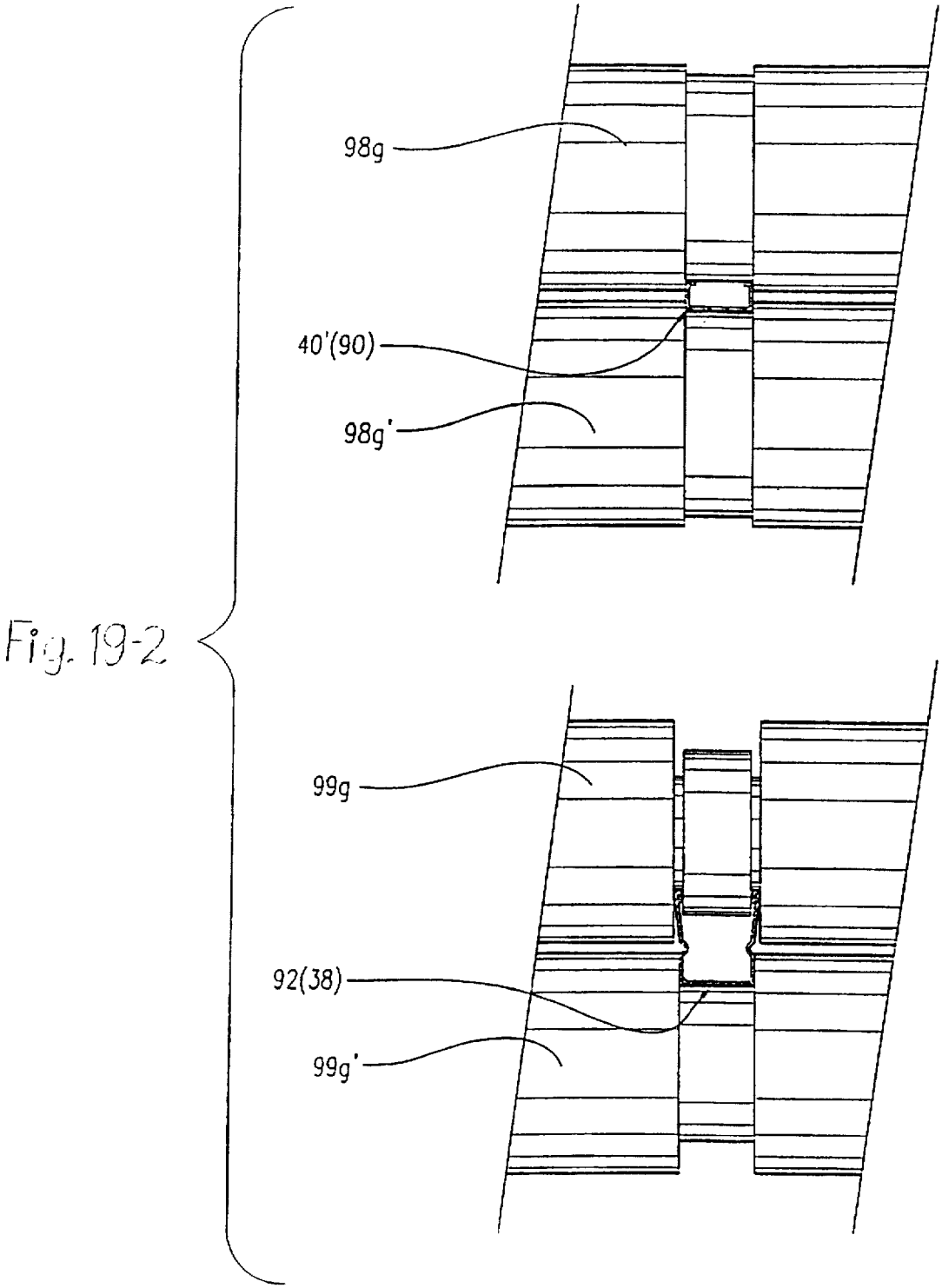

D. At Station "D", the aluminum sheet 90 enters through upper roller **98*a* and it is given initial bends that prepare it for subsequent roller. The steel sheet 92 enters through lower roller 99*a* and is given initial preparatory bends as well. Reference should be made here to FIG. 19-1 which shows roller configurations and the product cross sections at a point midway along the preparatory roller 98*d*, 99*d*** of Station "D".

E. At Station "E", the aluminum sheet 90 is given final bends and is completely formed as the internal member 40' and ready for insertion into the steel shell. The steel sheet 92 is nearly complete and is formed in a way that will allow the aluminum insert to be placed inside the steel shell at Station "G". Reference should be made here to FIG. 19-2 which depicts the roller configurations and product cross sections as they would appear in the preferred example at Station "E".

F. At Station "F", adhesive is applied to the aluminum insert just before it enters Station "G".

G. At Station "I", the insert 90 (now in the final form of internal member 40' ) and the shell 92 are joined and pass through Station "G". They are slightly pressed together to prepare the assembly for subsequent stations. Reference should be made here to FIG. 19-3 which depicts roller configurations and product cross-section at Station "G" of the preferred example.

Figure 4:
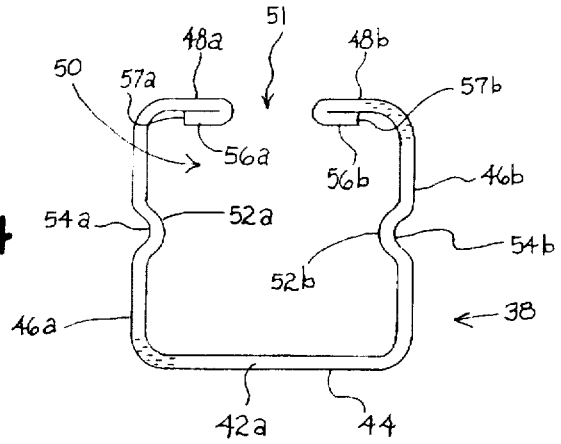
FIG. 4 is an isolated, end elevational view of an external member of the frame member of FIG. 3, the end opposite being a mirror image, in accordance with the preferred embodiment of the present invention.
Figure 5:
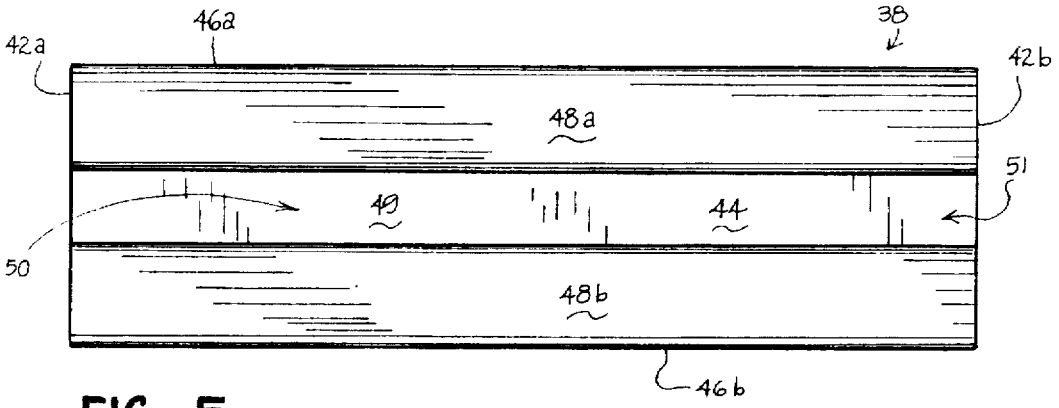
FIG. 5 is an isolated, top plan view of the external member of FIG. 4.
Figure 6:
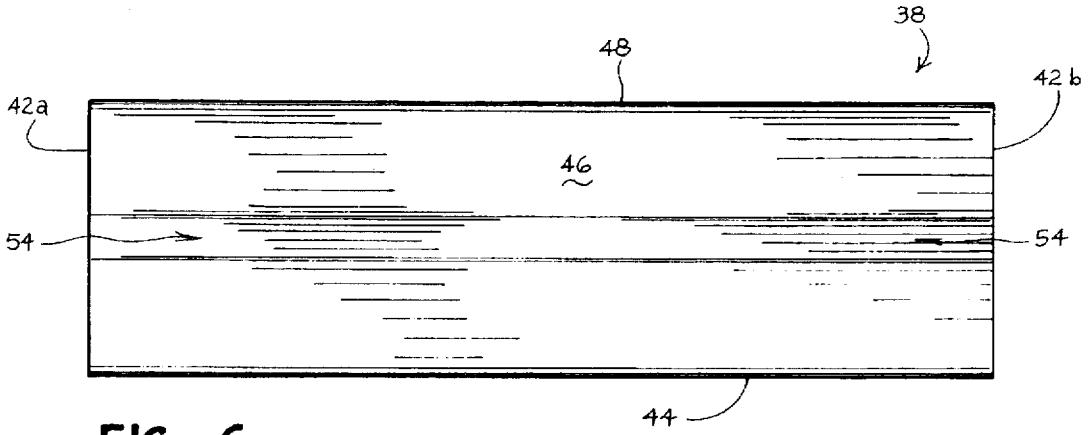
FIG. 6 is an isolated, side elevational view of the external member of FIG. 4, the side opposite being a mirror image.
Figure 7:
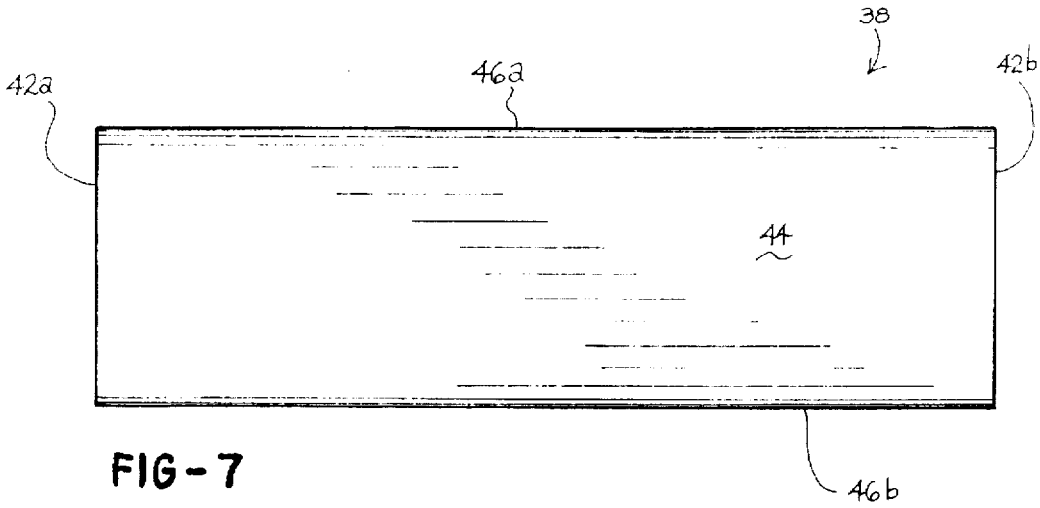
FIG. 7 is an isolated, bottom view of the external member of FIG. 4.
Figure 8:
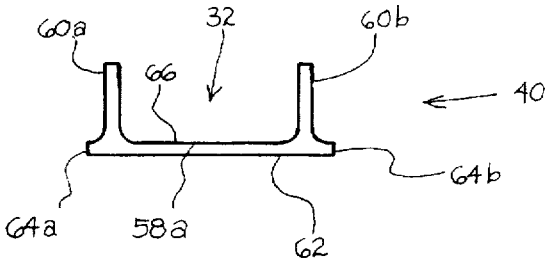
FIG. 8 is an isolated, end elevational view of an internal member of the frame member of FIG. 3, the end opposite being a mirror image, in accordance with a first preferred embodiment of the present invention.
Figure 9:
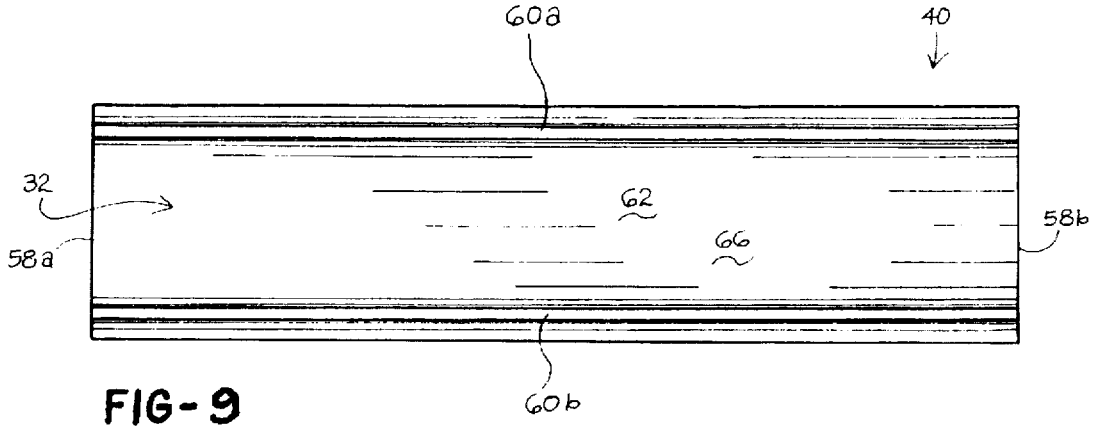
FIG. 9 is an isolated, top plan view of the internal member of FIG. 8.
Figure 10:
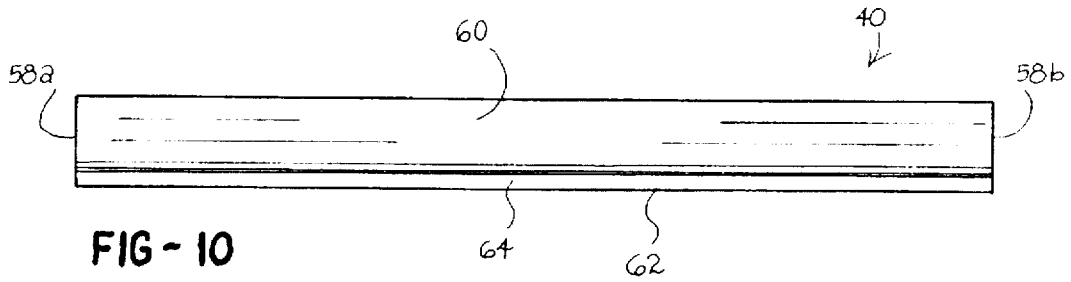
FIG. 10 is an isolated, side elevational view of the internal member of FIG. 8, the side opposite being a mirror image.
Figure 11:
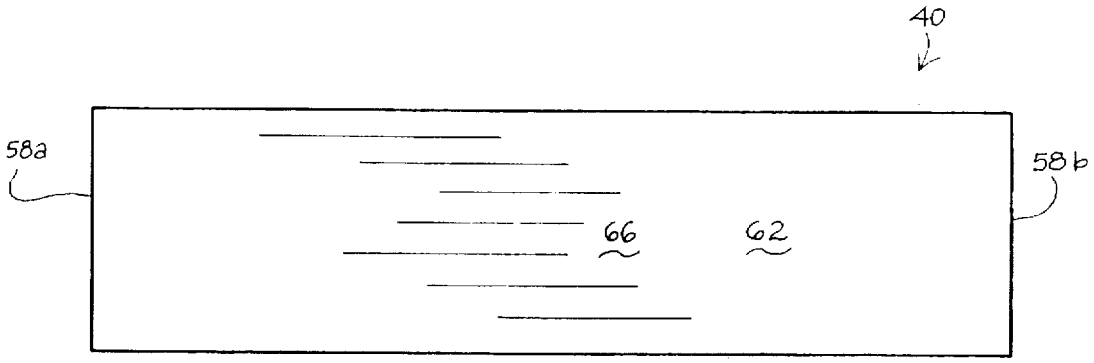
FIG. 11 is an isolated, bottom plan view of the internal member of FIG. 8.

H. At Station "H", the final bending station, the internal member 40' has been secured inside the external member 38 and the adhesive 89 is in place. Thus, the composite frame member 30' has been formed and finally assembled. Reference should be made here to FIG. 19-4 which depicts the roll configuration and product cross section at Station "H".

I. Station "I" represents an adhesive curing station where heat is applied to the composite assembly and the adhesive bonds the internal member 40' to the external member 38.

J. Station "J" represents a "flying cutoff station" where the composite member 30' is cut to length by a flying cutoff saw that travels temporarily with the member as it cuts. After the cut is made, the flying cutoff returns to cycle again.

The process as outlined above is believed to sufficiently describe the preferred embodiment of the fabricating process in accordance with the preferred embodiment of the present invention and is believed to be fully disclosing to one ordinarily skilled in the art.

Referring further to FIG. 3, once a frame member 30 is created, it will often be desirable to shape the frame member 30 by bending or cutting it. As an example, certain of the frame members 30 depicted in FIG. 2 are bent. During any such bending or other shaping, the external member 38 and internal member 40 synergistically cooperate in a manner that seeks to maintain the general structural shape of the frame member 30. For example, by virtue of the fact that the lateral member 62 of the internal member 40 is suspended within the internal cavity 50 and spans between the side walls **46*a,b*, the lateral member 62 seeks to maintain the distance between the side walls 46*a,b* such that they do not collapse into the internal cavity. As a further example, the tops of the upright members 60*a,b* abut the upper protrusions 56***a,b*, respectively, in a manner that seeks to keep the side walls 46*a,b* from spreading away from each other. This cooperation seeks to maintain the shape of the opening 51 (FIG. 4) and the internal cavity 50. The cooperation between the upright members 60*a,b* and the upper protrusions 56a,b further seeks to keep the upright members 60*a,b* from collapsing into the stapling channel 32, whereby the integrity of the stapling channel 32 is maintained. Also, the tops of the upright members 60*a,b* abut the underside of the upper walls 48*a,b*, respectively, in a manner that seeks to keep the upper walls 48*a,b* from collapsing into the stapling channel 32 or internal cavity 50.

In accordance with the preferred embodiment of the present invention, the strip member 37 is preferably formed from a single extruded piece of a suitable plastic material, such as, for example, polyvinyl chloride. For aesthetic purposes, the strip member 37 is often made to be the same color as the cover sheet 24 with which it will be used.

Whereas the present invention has sometimes been described herein as if components are oriented as shown in the drawings (e.g., referencing horizontal, vertical, top, bottom, etc.), it should be understood that these descriptions associated with this orientation have been used herein simply for purposes of ease of description; and the invention should not be limited by the descriptive terms associated with this orientation.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative relationships shown on the drawings are given as the preferred relative relationships, but the scope of the invention is not to be limited thereby.

I claim:

1. A composite frame member for use in constructing fabric covered awnings, said frame member comprising an elongated bendable external member defining an internal cavity and being formed with a slot extending at least partially along the length of said external member for access to said internal cavity, an elongated bendable internal member disposed within said internal cavity extending at least partially along the length of said external member, said internal member having a web portion that is aligned with, internally spaced from, and accessible through said slot in said external member, said internal member being formed of a material suitable for receiving and firmly holding piercing fasteners installed through said slot and into said web portion, and indentations formed in said external member below said web of said internal member for capturing and securing said internal member in place within said internal cavity of said external member.

2. A composite frame member as claimed in claim 1 and wherein said external member and said internal member are formed of metal.

3. A composite frame member as claimed in claim 2 and wherein said internal member is formed of aluminum.

4. A composite frame member as claimed in claim 3 and wherein said external member is formed of steel.

5. A composite frame member as claimed in claim 1 and wherein said external member is substantially square in cross-section having opposed spaced side walls, a bottom wall, and a top wall, said slot being formed along said top wall and said web portion of said internal member extending between said spaced side walls within said internal cavity.

6. A composite frame member as claimed in claim 5 and wherein said internal member further comprises a pair of spaced apart brace members projecting upwardly from said web portion and extending to respective positions on either side of said slot formed in said top wall of said external member.

7. A composite frame member as claimed in claim 1 and wherein said internal member is formed of aluminum of a sufficient softness to receive and hold staples driven therethrough.

8. A composite frame member as claimed in claim 7 and wherein said external member is formed of steel.

9. A composite frame member comprising:

a longitudinally extending external member, wherein said external member at least partially bounds and defines a longitudinally extending internal cavity, wherein said external member further defines an accessible longitudinally extending opening, and wherein said external member is constructed of a first material having a first hardness; and a longitudinally extending internal member disposed within said internal cavity and structurally reinforcing said external member, said internal member being generally C-shaped in end profile and defining a longitudinally extending opening generally aligned with said opening of said external member, wherein said internal member defines a web that extends fully, laterally across said internal cavity of said external member, said web being internally spaced from said longitudinally extending opening of said external member, and internally projecting indentations formed in said external member below said web for capturing and holding said internal member in place within said internal cavity, wherein said internal member is constructed of a second material that is distinct from said first material and has a second hardness that is less than said first hardness, whereby said internal member is distinct from said external member.

10. The composite frame member of claim 9, wherein said external member includes opposing side walls which at least partially define said internal cavity of said external member, and wherein said internal member spans said internal cavity to abut said side walls of said external member.

11. The composite frame member of claim 10,further comprising adhesive disposed between said external member and said internal member, affixing said internal member to said external member.

12. A composite frame member to which a cover sheet is attachable by a plurality of piercing members, the composite frame member comprising:

a longitudinally extending external member, wherein said external member includes an internal surface that at least partially bounds and defines a longitudinally extending internal cavity, wherein said external member further defines a longitudinally extending opening that is configured to receive at least a portion of the over sheet and the plurality of piercing members, and wherein said external member i s constructed of a first material having a first hardness; and a longitudinally extending member disposed within said internal cavity and structurally reinforcing said external member, wherein said internal member is readily accessible through said opening and is constructed and arranged to engage the plurality of piercing members in a manner that attaches the cover sheet to said internal member.

wherein said internal member is constructed of a second material that is distinct from said first material and has a second hardness that is less than said first hardness, whereby said external member is distinct from said internal member.

wherein said internal member includes a longitudinally extending first member, a longitudinally extending second member extending away from said first member, and a longitudinally extending third member also extending away from said first member, and wherein a longitudinally extending channel that is readily accessible through said opening is defined between said first member, said second member, and said third member, said second member abutting and tracking a first portion of said internal surface of said external member, and said third member abutting and tracking a second portion of said internal surface of said external member;

said first member of said internal member forming a web that is internally spaced from said opening in said external member and positioned to be pierced by and to hold firmly a plurality of piercing members installed through the cover sheet and through said opening in said external member to attach the cover sheet to said web; and internally protruding indentations formed in said external member below said web for capturing and securing said internal member in place within said internal cavity of said external member.

13. The composite frame member of claim 12, wherein said external member further includes:

a pair of side walls including a longitudinally extending first side wall, and a longitudinally extending second side wall distant from said first side wall, and a pair of top walls including a longitudinally extending first upper wall connected to said first side wall and extending toward said second side wall, said first upper wall including a first upper protrusion depending therefrom, and a longitudinally extending second upper wall connected to said second side wall extending toward said first side wall, said second upper wall including a second upper protrusion depending therefrom, wherein said internal cavity is at least partially defined between said first side wall and said second side wall.

14. The composite frame member of claim 13, wherein said second member of said internal member abuts and tracks a first portion of said first side wall of said external member and said third member of said internal member abuts a portion of said second side wall of said external member.

15. The composite frame member of claim 13, wherein:

said first side wall of said external member includes a first side protrusion extending toward said second side wall;

said second side wall of said external member includes a second side protrusion extending toward said first side wall;

said internal member further includes a first top wall extending from said second member towards said third member, said first top wall of said internal member abutting and tracking a portion of said first upper wall of said external member and abutting said first said side protrusion of said external member;

said internal member further includes a second top wall extending from said third member towards said second member, said second top wall of said internal member abutting and tracking a portion of said second upper wall of said external member and abutting said second said side protrusion of said external member.

16. The composite frame member of claim 12, further including adhesive disposed between abutting surfaces of said internal member and said external member to affix said internal member to said external member.

17. A construction assembly comprising:

a composite frame member including a longitudinally extending external member, wherein said external member at least partially bounds and defines a longitudinally extending internal cavity, wherein said external member further defines an accessible longitudinally extending opening, and wherein said external member is constructed of a first material having a first hardness, and a longitudinally extending internal member disposed within said internal cavity and structurally reinforcing said external member, said internal member being generally C-Shaped in end profile and defining a longitudinally extending opening generally aligned with said opening of said external member, wherein said internal member includes a web portion that extends fully, laterally across said internal cavity of said external member, said web portion being internally spaced from said opening of said external member for receiving piercing members installed through said opening in said external member, and wherein said internal member is constructed of a second material that is distinct from said first material and has a second hardness that is less than said first hardness, whereby said internal member is distinct from said external member;

a cover sheet extending through said opening and at least partially disposed within said internal cavity;

a plurality of piercing members disposed at least partially within said internal cavity and connecting said cover sheet to said web portion of said internal member; and a laterally extending strip member fixed into and substantially occluding said opening.

18. The composite frame member of claim 17, further comprising adhesive disposed between said external member and said internal member, affixing said internal member to said external member.

* * * * *